US010954458B2

(12) United States Patent
Raja et al.

(10) Patent No.: US 10,954,458 B2
(45) Date of Patent: Mar. 23, 2021

(54) COMPOSITION AND METHOD FOR DISPERSING SCALES AND SOLID DEPOSITS

(71) Applicant: Hindustan Petroleum Corporation Limited, Mumbai (IN)

(72) Inventors: Kanuparthy Naga Raja, Bangalore (IN); Venkateswarlu Cheerladinne, Bangalore (IN); Peddy Venkata Chalapathi Rao, Bangalore (IN); Nettem Venkateswarlu Choudary, Bangalore (IN); Sriganesh Gandham, Bangalore (IN)

(73) Assignee: Hindustan Petroleum Corporation Limited, Mumbai (IN)

( * ) Notice: Subject to any disclaimer, the term of this patent is extended or adjusted under 35 U.S.C. 154(b) by 256 days.

(21) Appl. No.: 15/999,352

(22) PCT Filed: Feb. 26, 2016

(86) PCT No.: PCT/IB2016/051063
§ 371 (c)(1),
(2) Date: Aug. 17, 2018

(87) PCT Pub. No.: WO2017/141077
PCT Pub. Date: Aug. 24, 2017

(65) Prior Publication Data

US 2019/0078030 A1 Mar. 14, 2019

(30) Foreign Application Priority Data

Feb. 17, 2016 (IN) ..... 201621005575

(51) Int. Cl.
*C10G 75/02* (2006.01)
*C10G 75/04* (2006.01)

(52) U.S. Cl.
CPC ..... *C10G 75/04* (2013.01); *C10G 75/02* (2013.01)

(58) Field of Classification Search
CPC ..... C10G 75/02; C10G 75/04
See application file for complete search history.

(56) References Cited

U.S. PATENT DOCUMENTS

| | | | | |
|---|---|---|---|---|
| 3,539,522 | A | 11/1970 | Smith | |
| 2010/0227785 | A1* | 9/2010 | Habeeb | C10M 141/10 508/370 |

FOREIGN PATENT DOCUMENTS

| | | |
|---|---|---|
| WO | 2007106943 | 9/2007 |
| WO | 2011002745 | 1/2011 |
| WO | 2011090610 | 7/2011 |

OTHER PUBLICATIONS

Swapnil A. Dharaskar et al "Synthesis, characterization, and application of novel trihexyl tetradecyl phosphonium bis (2,4,4-trimethylpentyl) phosphinate for extractive desulfurization of liquid fuel" J. Fuel Processing Technology, vol. 123, pp. 1-10, Jul. 2014. Abstract.

* cited by examiner

*Primary Examiner* — Randy Boyer
(74) *Attorney, Agent, or Firm* — Sand, Sebolt & Wernow Co., LPA

(57) ABSTRACT

The present disclosure relates to a composition for removing scales and solid deposits. The composition comprises at least one dispersant salt, at least one hydrocarbon, and at least one ionic liquid.

9 Claims, 1 Drawing Sheet

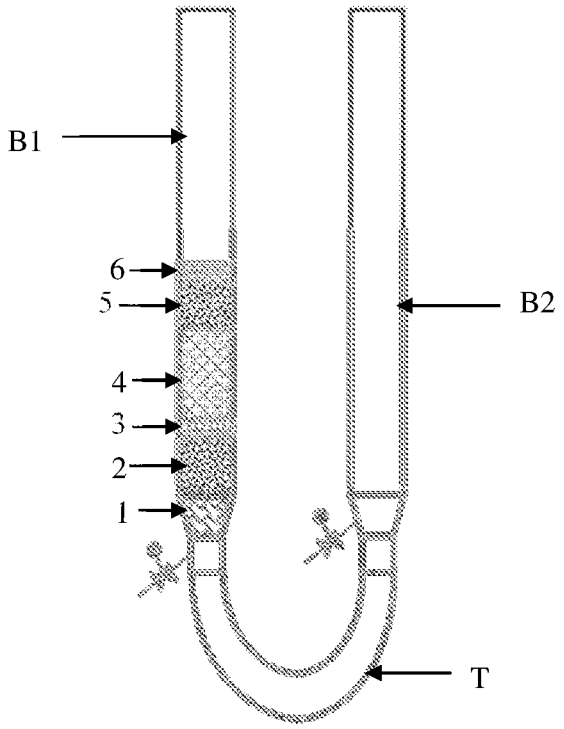
B1
6
5
4
3
2
1
B2
T

COMPOSITION AND METHOD FOR DISPERSING SCALES AND SOLID DEPOSITS

FIELD

The present disclosure relates to a composition and a method for dispersing scales and solid deposits

BACKGROUND

Hydrocarbons such as crude oil, tar sands, bitumen, tight oil, refined petroleum fractions, and the like contain metals, sand grits, and gum forming compounds. When such hydrocarbon streams are handled in the process industry, most often the corrosive products formed on the inner surface of the process equipments get carried along with the hydrocarbon streams. In addition, organic gum is formed inside the process equipments due to the characteristics of the compounds present in the hydrocarbons. These lead to deposition of organic and inorganic solids in the process equipments such as on the inner walls of heat exchangers, pipelines, pumps, reactors, catalyst bed, valves, etc. The presence of such solid deposits perturbs the operation of the plant. Such solid deposits can block the flow of process streams in the equipments and lead to pressure drop increase, reduce the heat transfer between surfaces, foul the catalyst bed, thereby reducing the effectiveness of the catalyst bed, corrosion of inner walls of equipments and scale formation on the surface, leading to frequent maintenance. Continuous operation of the plant becomes a challenge if the solid deposits are more and hence lead to non-uniform flow distribution and fluctuations in the key parameters of the operation.

Such solid deposits can be removed from the process equipment internals by forced shut down of the plant and manually scavenging the deposits. This is a time consuming process and leads to loss of production. The solid deposits, however, can be disentangled from their location and kept either freely suspended in the process stream or removed along with the process stream. This can be done during an online plant operation by using a dispersant chemical.

I heretore, the inventors of the present disclosure envisage a dispersant composition and a method of using the dispersant composition to remove scales and solid deposits in a process industry.

OBJECTS

Some of the objects of the present disclosure, which at least one embodiment herein satisfies, are as follows:

It is an object of the present disclosure to ameliorate one or more problems of the prior art or to at least provide a useful alternative.

An object of the present disclosure is to remove scales and solid deposits from process equipments.

Another object of the present disclosure is to remove solid deposits from a catalyst bed.

Other objects and advantages of the present disclosure will be more apparent from the following description, which is not intended to limit the scope of the present disclosure.

SUMMARY

The present disclosure relates to a composition for removing scales and solid deposits from a location selected from at least one of the inner walls of a reactor, the inner walls of pipelines, the inner walls of heat exchangers, valves, and catalyst bed. The composition comprises 2 wt % to 60 wt % of at least one dispersant salt, 40 wt % to 85 wt % of at least one hydrocarbon and 0.1 wt % to 45 wt % of at least one additive.

The hydrocarbon can be at least one selected from the group consisting of hydrocarbons with the carbon number range of $C_5$ to $C_{50}$.

The present disclosure also relates to the method by which the scales and solid deposits can be removed.

BRIEF DESCRIPTION OF THE ACCOMPANYING DRAWING

A composition for removal of solid deposits will now be described with the help of the accompanying drawing, in which:

FIG. 1 illustrates a trickling bed system in accordance with the present disclosure.

DETAILED DESCRIPTION

In hydroprocessing units, the corrosive products from upstream of the reactor, inorganic materials such as sand grits, and other gum forming compounds create solid deposits on the catalyst bed inside the reactor. The present disclosure, therefore, provides a composition for removal of solid deposits from a location, wherein the location is not limited to the inner walls of a reactor, the inner walls of pipelines, the inner walls of heat exchangers, valves and a catalyst bed.

The composition of the present disclosure comprises at least one dispersant salt, at least one hydrocarbon, and at least one additive. The dispersant salt includes, but is not limited to, ammonium salt.

The hydrocarbon includes, but is not limited to, $C_5$ to $C_{50}$ carbon atoms per molecule. In accordance with one embodiment of the present disclosure, the hydrocarbon can be at least one selected from the group consisting of naphtha, gasoline, diesel, kerosene, benzene, xylene, mesitylene, and toluene.

The additive includes, but is not limited to ionic liquids. In accordance with one embodiment of the present disclosure, ionic liquid can be at least one selected from the group consisting of 1-Butyl-3-methylimidazolium tetrafluoroborate, Tributylmethylammonium methyl sulfate, 1-Butyl-3-methylimidazolium hexafluorophosphate and Trihexyltetradecylphosphonium bis(2,4,4trimethylpentyl)phosphinate.

Solids, such as, iron sulfide deposited in the reactor and on the catalyst bed during hydroprocessing of the crude oil fractions, result in fouling of the reactor and the catalyst bed as described herein above. Moreover, depending upon the porosity of the solids deposited in the reactor and on the catalyst bed, the flow-rates of the reactants entering in the reactor are affected, thereby increasing the pressure drop in the reactor.

The addition of the dispersant composition in the feed stream facilitates in improving the separation of solids from the deposited area (location), thereby inhibiting settling, and clumping of the solids in the reactor and on the catalyst bed. Due to this, fouling of the reactor and the catalyst bed is inhibited and hence the flow rate of the process fluid is increased across the catalyst bed.

Moreover, if a portion of the deposited solids is carried along with the hydrocarbon in different process equipments like heat exchangers, valves and pipelines, and is deposited therein, then the composition of the present disclosure facilitates in removing the deposited solids therefrom.

The composition of the present disclosure can be used for the removal of solids from a location which can be at least one of the inner walls of heat exchangers, the inner walls of pipelines, the inner walls of a reactor, catalyst bed, and valves. The present disclosure provides a method of removing the solid deposits from the location.

The present disclosure also provides a method for preparing the dispersant salt. The method is carried out by the following steps:

In the first step, an acid is cooled to a first pre-determined temperature to obtain a cooled acid. In the second step, a base is cooled to a second pre-determined temperature to obtain a cooled base. In the third step, the cooled base is added to the cooled acid at a pre-determined rate while stirring at a pre-determined speed, at a third pre-determined temperature and for a pre-determined time period to obtain the dispersant salt. In accordance with one embodiment of the present disclosure, the cooled base can also be added to the cooled acid in a drop wise manner.

The first pre-determined temperature can be in the range of −15° C. to 25° C. and the second pre-determined temperature can be in the range of −10° C. to 25° C. The pre-determined rate of addition can be in the range of 1 ml/min to 100 ml/min, the pre-determined stirring speed can be in the range of 500 rpm to 1000 rpm, the third pre-determined temperature can be in the range of −10° C. to 25° C., and the pre-determined time period can be in the range of 2 hours to 8 hours.

After formation of the dispersant salt, stirring is continued further in the reactor, for a time period in the range of 2 hours to 4 hours, to ensure completion of the reaction. The acid can be at least one selected from the group consisting of linear alkyl benzene sulfonic acid, lactic acid, acetic acid, formic acid, oleic acid, linoleic acid, palmitic acid, citric acid, and uric acid.

In accordance with one embodiment of the present disclosure, the purity of the organic acid used in the process for preparing the dispersants ranges from 85% to 99%.

The base includes, but is not limited to, an organic compound containing nitrogen. The base can be at least one selected from the group consisting of ethylamine, isopropylamine, butylamine, pentylamine, hexylamine, pyridine, pyrrolidine imidazole, piperidine, benzimidazole, pyrazine, alkyl pyrazine, and morpholine. In accordance with an exemplary embodiment of the present disclosure, isopropyl amine (IPA) is added to Linear Alkyl Benzene Sulfonic Acid (LABSA) to obtain a linear alkylbenzene sulfonated isopropyl ammonium salt. In accordance with another exemplary embodiment of the present disclosure, Isopropyl Amine (IPA) is added to Dodecyl Benzene Sulfonic Acid (DDBSA) to obtain a dodecyl benzene sulfonated isopropyl ammonium salt.

In accordance with still another exemplary embodiment of the present disclosure, isopropyl amine (IPA) is added to oleic acid to obtain oleic acid isopropyl ammonium salt.

In accordance with one embodiment of the present disclosure, at least one inorganic acid can be used for preparing the dispersant salt. The inorganic acid can be at least one selected from the group consisting of sulfuric acid, nitric acid, and carbonic acid. In accordance with one embodiment of the present disclosure, the concentration of the inorganic acid can be in the range of 0.2 wt % to 6 wt % of the total composition.

Further, a mixture of dispersant salts can be added to the hydrocarbon at a fourth predetermined temperature to obtain the composition for removal of solid deposits. The fourth predetermined temperature can be in the range of 10° C. to 45° C. After addition of the dispersant salt in the hydrocarbon, the additive can be added to obtain the final composition for removal of solid deposits effectively.

In accordance with one embodiment of the present disclosure, a mixture of dodecyl benzene sulfonated isopropyl ammonium salt and oleic acid-isopropyl ammonium salt can be added in 1:1 molar ratio in the hydrocarbon and 1 wt % of tributylmethylammonium methyl sulfate is added to obtain the dispersant composition, for effectively removing solid deposits from the reactor, thereby obviating fouling of the reactor and the catalyst bed.

The present disclosure also provides a method for removing solid deposits from the location. The method is carried out by mixing a pre-determined concentration of the dispersant composition in the process stream at a temperature in the range of 15° C. to 460° C. and at a pressure in the range of 1 bar to 200 bar. The dispersant composition is allowed to contact the location, thereby dispersing and reducing the solid deposits therefrom.

The pre-determined concentration of the dispersant salt can be in the range of 2 wt % to 60 wt % of the total composition. The pre-determined concentration of the hydrocarbon can be in the range of 40 wt % to 85 wt % of the total composition. The pre-determined concentration of the additive can be in the range of 0.1 wt % to 45 wt % of the total composition.

The present disclosure is further described in light of the following experiments which are set forth for illustration purpose only and not to be construed for limiting the scope of the disclosure. The following experiments can be scaled up to industrial/commercial scale.

Experiment 1: Preparation of Dispersant Salt:

A. Method for the Preparation of Dodecyl Benzene Sulfonated Isopropyl Ammonium Salt (99.9%).

1 mmol of DDBSA of 99.9% purity was added and cooled to 15° C. in a first round bottom flask, which was kept in an ice bath, to form a cooled DDBSA. 1 mmol of IPA was added and cooled to 10° C. in a second round bottom flask, which was kept in an ice bath, to form a cooled IPA. The cooled IPA was then added at a flow rate of 3 ml/min to the first round bottom flask in a drop-wise manner. The reaction between the cooled DDBSA and the cooled IPA was carried out at 15° C. with constant stirring for 2 hours to obtain the dodecyl benzene sulfonated isopropyl ammonium salt (99.9%). The reaction temperature was maintained below 20° C. to avoid loss of IPA. After formation of the dodecyl benzene sulfonated isopropyl ammonium salt (99.9%), stirring was continued in the first round bottom flask for 4 hours at room temperature to ensure the completion of the reaction.

B. Method for the Preparation of Linear Alkyl Benzene Sulfonated Isopropyl Ammonium Salt (90%).

1 mmol of LABSA of 90% purity was added and cooled to 15° C. in a first round bottom flask, which was kept in an ice bath, to form a cooled LABSA. 1 mmol of IPA was added and cooled to 20° C. in a second round bottom flask, which was kept in an ice bath, to form a cooled IPA. The cooled IPA was then added at a flow rate of 3 ml/min to the first round bottom flask containing cooled LABSA in a drop-wise manner. The reaction between the cooled LABSA and the cooled IPA was carried out at 15° C. under stirring for 2 hours to obtain the linear alkyl benzene sulfonated isopropyl ammonium salt (90%). The reaction temperature was maintained below 20° C. to avoid loss of IPA. After formation of the linear alkyl benzene sulfonated isopropyl ammonium salt (90%), stirring was continued in the first round bottom flask for 4 hours at room temperature to ensure completion of the reaction.

C. Method for the Preparation of Linear Alkyl Benzene Sulfonated Isopropyl Ammonium Salt (96%).

1 mmol of LABSA of 96% purity was added and cooled to 15° C. in a first round bottom flask, which was kept in an ice bath, to form a cooled LABSA. 1 mmol of IPA was added and cooled to 20° C. in a second round bottom flask, which was kept in an ice bath, to form a cooled IPA. The cooled IPA was then added at a flow rate of 3 ml/min to the first round bottom flask in a drop-wise manner. The reaction between the cooled LABSA and the cooled IPA was carried out at 15° C. under stirring for 2 hours to obtain the linear alkyl benzene sulfonated isopropyl ammonium salt (96%). The reaction temperature was maintained below 20° C. to avoid loss of IPA. After formation of the linear alkyl benzene sulfonated isopropyl ammonium salt (96%), stirring was continued in the first round bottom flask for 4 hours at room temperature to ensure completion of the reaction.

D. Method for the Preparation of Oleic Acid-Isopropyl Ammonium Salt (65%).

1 mmol of oleic acid of 65% purity was added and cooled to 25° C. in a first round bottom flask, which was kept in an ice bath, to form a cooled oleic acid. 1.5 mmol of IPA was added and cooled to 10° C. in a second round bottom flask, which was kept in an ice bath, to form a cooled IPA. The cooled IPA was then added at a flow rate of 3 ml/min to the first round bottom flask in a drop-wise manner. The reaction between the cooled oleic acid and the cooled IPA was carried out at 15° C. under stirring for 2 hours to obtain the oleic acid sulfonated isopropyl ammonium salt (65%). The reaction temperature was maintained below 20° C. to avoid loss of IPA. After formation of the linear alkyl benzene sulfonated isopropyl ammonium salt (65%), stirring was continued in the first round bottom flask for 4 hours at room temperature to ensure completion of the reaction.

E. Method for the Preparation of Oleic Acid-Isopropyl Ammonium Salt (99%).

1 mmol of oleic acid of 99% purity was added and cooled to 25° C. in a first round bottom flask, which was kept in an ice bath, to form a cooled oleic acid. 1.5 mmol of IPA was added and cooled to 10° C. in a second round bottom flask, which was kept in an ice bath, to form a cooled IPA. The cooled IPA was then added at a flow rate of 3 ml/min to the first round bottom flask in a drop-wise manner. The reaction between the cooled oleic acid and the cooled IPA was carried out at 15° C. under stirring for 2 hours to obtain the oleic acid sulfonated isopropyl ammonium salt (99%). The reaction temperature was maintained below 20° C. to avoid loss of IPA. After formation of the linear alkyl benzene sulfonated isopropyl ammonium salt (99%), stirring was continued in the first round bottom flask for 4 hours at room temperature to ensure completion of the reaction.

Experiment 2: Preparation of Dispersant Composition in Accordance with the Present Disclosure:

F. Method for the Preparation of a Dispersant Composition of Linear Alkyl Benzene Sulfonated Isopropyl Ammonium Salt (96%) and Trihexyltetradecylphosphonium bis(2,4,4trimethylpentyl)phosphinate.

30 gm of linear alkyl benzene sulfonated isopropyl ammonium salt obtained in experiment 1(C) was mixed with 70 gm of diesel. To the so obtained solution 4.17 gm of Trihexyltetradecylphosphonium bis(2,4,4trimethylpentyl) phosphinate (ionic liquid) was added under stirring. The stirring of the mixture was continued till the complete mixture becomes a homogeneous solution. The so obtained homogenous solution was 104.17 gm which was used as the composition for dispersing and removing solid deposits G. Method for the Preparation of a Dispersant Composition Containing a Mixture of Linear Alkyl Benzene Sulfonated Isopropyl Ammonium Salt (96%) and the Oleic Acid-Isopropyl Ammonium Salt with Ionic Liquid.

15 gm of mixture of linear alkyl benzene sulfonated isopropyl ammonium salt (96%) obtained in experiment 1(C) and 15 gm of oleic acid-isopropyl ammonium salt obtained experiment 1(D) was mixed with 70 gm of diesel. To the so obtained solution 1.01 gm of tributylmethylammonium methyl sulfate (ionic liquid) was added under stirring. The stirring of the mixture was continued till the complete mixture becomes a homogeneous solution. The so obtained homogenous solution was 101.01 gm which was used as the composition for dispersing and removing solid deposits H. Method for the Preparation of a Dispersant Composition Containing a Mixture of Dodecyl Benzene Sulfonated-Isopropyl Ammonium Salt and Oleic Acid-Isopropyl Ammonium Salt with Ionic Liquid.

15 gm of dodecyl benzene sulfonated-isopropyl ammonium salt (99.9%) obtained in experiment 1(A) and 15 gm of oleic acid-isopropyl ammonium salt obtained in experiment 1(E) was mixed with 70 gm of diesel. To the so obtained solution 4.17 gm of tributylmethylammonium methyl sulfate (ionic liquid) was added under stirring. The stirring of the mixture was continued till the complete mixture becomes a homogeneous solution. The so obtained homogenous solution was 104.17 gm which was used as the composition for dispersing and removing solid deposits I. Method for the Preparation of a Dispersant Composition Containing Mixture of Linear Alkyl Benzene Sulfonated Isopropyl Ammonium Salt (96%) and Oleic Acid-Isopropyl Ammonium Salt with Ionic Liquid.

15 gm of linear alkyl benzene sulfonated isopropyl ammonium salt (96%) obtained in experiment 1(C) and 15 gm of oleic acid-isopropyl ammonium salt obtained in experiment 1(E) was mixed with 70 gm of diesel. To the so obtained solution 4.17 gm of tributylmethylammonium methyl sulfate (ionic liquid) was added under stirring. The stirring of the mixture was continued till the complete mixture becomes a homogeneous solution. The so obtained homogenous solution was 104.17 gm which was used as the composition for dispersing and removing solid deposits.

J. Method for the Preparation of a Dispersant Composition Containing Mixture of Linear Alkyl Benzene Sulfonated Isopropyl Ammonium Salt (96%) and Oleic Acid-Isopropyl Ammonium Salt with Ionic Liquid.

15 gm of linear alkyl benzene sulfonated isopropyl ammonium salt (96%) obtained in experiment 1 (C) and 15 gm of oleic acid-isopropyl ammonium salt obtained in experiment 1 (E) was mixed with 70 gm of diesel. To the so obtained solution 4.17 gm of trihexyltetradecylphosphonium bis(2,4,4trimethylpentyl)phosphinate (ionic liquid) was added under stirring. The stirring of the mixture was continued till the complete mixture becomes a homogeneous solution. The so obtained homogenous solution was 104.17 gm which was used as the composition for dispersing and removing solid deposits.

Experiment 3: Evaluation of the Performance of the Dispersant Composition

The performance of the dispersant composition prepared in experiment 2 containing the ammonium salt prepared in experiment 1 was evaluated by studying the flow-rate of Mineral Turpentine Oil (MTO) containing the dispersant formulation in a fixed bed covered with a scale of iron sulphide.

Test Apparatus and Methodology of Evaluation:

As shown in FIG. 1, the trickling bed system (100) includes:

- a set of columns (B1 and B2) connected with a tubing arrangement (T) to make a U-Tube configuration; and
- a packed bed The U-tube configuration was used for studying the effectiveness of the sample compositions (tabulated in Table-1). One of the columns (B1) was filled with different layers of solids (1 to 6), viz., a layer of sand grits (1), a layer of alumina balls (2 and 4), a layer of glass wool (3), a layer of silicon carbide (5) and a layer of iron sulfide (6), to form the packed bed reactor. Particularly, the layer of iron sulfide (6) was placed on the layer of silicon carbide (5).

This type of packing was repeated over several beds depending upon the density, viscosity and other physical properties of the samples (tabulated in Table-1) to be tested in the experiment. The size of the alumina balls (2 and 4) in the packed bed reactor can be varied depending upon the sample(s) (tabulated in Table-1) to be tested in the experiment. The length of the tubing (T) between the set of columns (B1 and B2) depends upon the density, viscosity and other physical properties of the samples (tabulated in Table-1) to be tested in the experiment.

The column (B1) (as shown in FIG. 1) was filled in such a way that the sample to be tested does not overflow from the column (B2), during the experiment. The time required by the sample to disperse the layer of iron sulfide (6) and trickle down the packed bed reactor was recorded, to measure the trickling rate.

In this experiment, the sample to be tested was dosed in MTO at a concentration of 0.2 wt %. The experiment was repeated for all the samples tabulated in Table-1. The trickling rate of various sample composition are tabulated in Table-1.

TABLE 1

| Sr. No | Composition of the Samples | Trickling rate (ml/min) |
|---|---|---|
| 1 | Control-No dispersant added to the test sample-(Test sample is MTO) | 15.96 |
| 2 | LABSA isopropylamine salt (95%) in diesel with 1% IL 1-butyl-3-methylimidazolium tetrafluoroborate | 37.24 |
| 3 | LABSA isopropylamine salt (95%) in diesel with IL 4% 1-butyl-3-methylimidazolium tetrafluoroborate | 43.03 |
| 4 | LABSA isopropylamine salt (96%) mixed with Diesel and 4% IL (Butyl-3-methylimidazoliumhexafluorophosphate) | 22.28 |
| 5 | LABSA isopropylamine salt (96%) mixed with Diesel and 4% IL {Trihexyltetradecylphosphonium bis(2,4,4trimethylpentyl)phosphinate} | 25.12 |
| 6 | LABSA isopropylamine salt (96%) mixed with Diesel and 4% IL (Tributylmethylammonium methyl sulfate) | 28.30 |
| 7 | Oleic Acid isopropylamine salt mixed with Diesel and 4% IL (Butyl-3-methylimidazoliumhexafluorophosphate) | 21.83 |
| 8 | Oleic Acid isopropylamine salt mixed with Diesel and 4% IL {Trihexyltetradecylphosphonium bis(2,4,4trimethylpentyl)phosphinate} | 29.78 |
| 9 | Oleic Acid isopropylamine salt mixed with Diesel and 4% IL (Tributylmethylammonium methyl sulfate) | 25.12 |

From Table-1, it is observed that the trickling rate of MTO improves with the addition of varying amounts of the dispersant composition, as compared to the trickling rate without the addition of the dispersant composition.

Technical Advances and Economical Significance

The present disclosure described herein above has several technical advantages including, but not limited to, the realization of a composition that:

- reduces the pressure drop across the reactor and the catalyst bed;
- increases the catalytic activity of the catalyst by reducing the fouling of catalyst;
- increases the throughput, by removing organic and inorganic scales and solid deposits, such as iron sulfide, gums, etc. efficiently from the reactor and the catalyst bed; and
- requires less time for removing the solid deposits The disclosure has been described with reference to the accompanying embodiments which do not limit the scope and ambit of the disclosure. The description provided is purely by way of example and illustration.

The embodiments herein and the various features and advantageous details thereof are explained with reference to the non-limiting embodiments in the following description. Descriptions of well-known components and processing techniques are omitted so as to not unnecessarily obscure the embodiments herein.

The foregoing description of the specific embodiments so fully revealed the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The use of the expression "at least" or "at least one" suggests the use of one or more elements or ingredients or quantities, as the use may be in the embodiment of the invention to achieve one or more of the desired objects or results.

Any discussion of documents, acts, materials, devices, articles or the like that has been included in this specification is solely for the purpose of providing a context for the invention. It is not to be taken as an admission that any or all of these matters form part of the prior art base or were common general knowledge in the field relevant to the invention as it existed anywhere before the priority date of this application.

In view of the wide variety of embodiments to which the principles of the present invention can be applied, it should be understood that the illustrated embodiments are exemplary only. While considerable emphasis has been placed herein on the particular features of this invention, it will be appreciated that various modifications can be made, and that many changes can be made in the preferred embodiments without departing from the principle of the invention. These and other modifications in the nature of the invention or the preferred embodiments will be apparent to those skilled in the art from the disclosure herein, whereby it is to be distinctly understood that the foregoing descriptive matter is to be interpreted merely as illustrative of the invention and not as a limitation.

The invention claimed is:

1. A dispersant composition for removing scales and solid deposits from a location selected from at least one of the inner walls of a reactor, the inner walls of pipelines, the inner walls of heat exchangers, valves and a catalyst bed, said composition comprising:

at least one dispersant salt in the range of 2 wt % to 60 wt %;

at least one hydrocarbon in the range of 40 wt % to 85 wt %; said hydrocarbon is selected from the group consisting of $C_1$ to $C_{50}$ carbon atom(s); and at least one additive in the range of 0.1 wt % to 45 wt %; said additive is selected from the group of ionic liquids;

wherein said at least one dispersant salt is selected from a group consisting of linear alkyl benzene sulfonated isopropyl ammonium salt, dodecyl benzene sulfonated isopropyl ammonium salt, and oleic acid isopropyl ammonium salt.

2. The dispersant composition as claimed in claim 1, wherein said additive is at least one selected from the group consisting of 1-butyl-3-methylimidazolium tetrafluoroborate, tributylmethylammonium methyl sulfate, 1-butyl-3-methylimidazolium hexafluorophosphate and trihexyltetradecylphosphonium bis(2,4,4trimethylpentyl)phosphinate.

3. The dispersant composition as claimed in claim 1, wherein said scales and solid deposits comprise at least one organic and/or inorganic deposits selected from sand, grits, iron sulfide particles and organic gums.

4. A method for preparing the dispersant composition as claimed in claim 1, wherein said method comprises the following steps:

a) preparing a dispersant salt by:

cooling an acid to a first pre-determined temperature to obtain a cooled acid;

cooling a base to a second pre-determined temperature to obtain a cooled base;

adding said cooled base to said cooled acid at a pre-determined rate while stirring at a pre-determined speed, at a third pre-determined temperature, and for a pre-determined time period to obtain said dispersant salt;

b) adding at least one hydrocarbon to at least one dispersant salt at a fourth pre-determined temperature followed by adding at least one additive to obtain said dispersant composition.

5. The method as claimed in claim 4, wherein said acid is at least one selected from the group consisting of alkyl aryl sulfonic acid, lactic acid, acetic acid, formic acid, oleic acid, linoleic acid, palmitic acid, citric acid, and uric acid.

6. The method as claimed in claim 4, wherein said base is at least one selected from the group consisting of ethylamine, isopropylamine, butylamine, pentylamine, hexylamine, pyridine, pyrrolidine imidazole, piperidine, benzimidazole, pyrazine, alkyl pyrazine and morpholine.

7. The method as claimed in claim 4, wherein said:

first pre-determined temperature is in the range of −15° C. to 25° C.;

second pre-determined temperature is in the range of −10° C. to 25° C.;

third pre-determined temperature is in the range of −10° C. to 25° C.; and fourth pre-determined temperature is in the range of 10° C. to 45° C.

8. The method as claimed in claim 4, wherein said:

pre-determined rate is in the range of 1 ml/min to 100 ml/min;

pre-determined speed is in the range of 500 rpm to 1000 rpm; and pre-determined time period is in the range of 2 hours to 8 hours.

9. The method as claimed in claim 4, wherein the molar ratio of said cooled acid and said cooled base is 1:1.

* * * * *